US008329371B2

(12) United States Patent
Mikuriya et al.

(10) Patent No.: US 8,329,371 B2
(45) Date of Patent: Dec. 11, 2012

(54) TONER FOR NON-MAGNETIC ONE-COMPONENT DEVELOPER, METHOD OF PREPARING THE TONER, DEVELOPER AND IMAGE FORMING METHOD

(75) Inventors: Yoshihiro Mikuriya, Nishinomiya (JP); Hideaki Yasunaga, Ibaraki (JP); Hiroaki Katoh, Nagaokakyo (JP); Kazuoki Fuwa, Toyonaka (JP); Masayuki Hagi, Minoh (JP); Masahide Inoue, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 783 days.

(21) Appl. No.: 11/963,279

(22) Filed: Dec. 21, 2007

(65) Prior Publication Data

US 2008/0153018 A1 Jun. 26, 2008

(30) Foreign Application Priority Data

Dec. 25, 2006 (JP) ..... 2006-347262

(51) Int. Cl.
*G03G 9/00* (2006.01)

(52) U.S. Cl. ..... 430/108.8; 430/48; 430/109.3; 430/137.1; 430/137.18

(58) Field of Classification Search ..... 430/48, 430/108.8, 109.3, 137.1, 137.18
See application file for complete search history.

(56) References Cited

U.S. PATENT DOCUMENTS

| | | | | |
|---|---|---|---|---|
| 6,153,347 | A * | 11/2000 | Kabai et al. | 430/108.4 |
| 6,656,653 | B2 * | 12/2003 | Mitsuhashi et al. | 430/108.23 |
| 6,682,866 | B2 * | 1/2004 | Sugiyama et al. | 430/108.1 |
| 2006/0046176 | A1 * | 3/2006 | Hidaka | 430/108.8 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2006/0292474 | A1 | 12/2006 | Mikuriya et al. | |
| 2007/0026335 | A1 | 2/2007 | Yamamoto et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0190443 | A1 | 8/2007 | Hagi et al. | |
| 2007/0207399 | A1 | 9/2007 | Kadota et al. | |
| 2007/0212630 | A1 | 9/2007 | Yasunaga et al. | |
| 2007/0217842 | A1 | 9/2007 | Kato et al. | |
| 2007/0238042 | A1 | 10/2007 | Yasunaga et al. | |

FOREIGN PATENT DOCUMENTS

| | | |
|---|---|---|
| JP | 2000-305309 | 11/2000 |
| JP | 3458629 | 8/2003 |
| JP | 2004-109697 | 4/2004 |
| JP | 2004-126268 | 4/2004 |
| JP | 2006-154528 | 6/2006 |
| JP | 2007-25633 | 2/2007 |
| JP | 2007-187959 | 7/2007 |

OTHER PUBLICATIONS

Machine translation, JP-2003-076066.*
U.S. Appl. No. 12/051,248, filed Mar. 19, 2008, Hagi, et al.
U.S. Appl. No. 12/241,656, filed Sep. 30, 2008, Yasunaga, et al.
U.S. Appl. No. 12/197,651, filed Aug. 25, 2008, Katoh, et al.
U.S. Appl. No. 11/624,525, filed Jan. 18, 2007, Hideaki Yasunaga, et al.

* cited by examiner

*Primary Examiner* — Thorl Chea
(74) *Attorney, Agent, or Firm* — Oblon, Spivak, McClelland, Maier & Neustadt, L.L.P.

(57) ABSTRACT

A non-magnetic toner, including a binder resin; a wax present dispersing in the toner in the shape of a particle; and a colorant, wherein the wax having a particle diameter not less than 2.0 μm and less than 3.0 μm is not less than 20% and less than 40% by number based on total number thereof; the wax has a mode value not less than 1.5 μm and less than 2.0 μm in a frequency distribution of 0.1 μm width; and the following relationship is satisfied:

$$45<XZ/Y<62$$

wherein X represents a softening point (° C.) of the toner; Y represents a volume-average particle diameter (μm) of the toner; and Z represents a total parts by weight of the wax included in 100 parts by weight of the toner.

18 Claims, 1 Drawing Sheet

TONER FOR NON-MAGNETIC ONE-COMPONENT DEVELOPER, METHOD OF PREPARING THE TONER, DEVELOPER AND IMAGE FORMING METHOD

BACKGROUND OF THE INVENTION

1. Field of the Invention

The present invention relates to a toner for non-magnetic one-component developer, a method of preparing the toner, and a developer and an image forming method using the toner.

2. Discussion of the Background

Conventionally, heat roll methods are widely used for fixing a toner. A toner image contacts the surface of the heat roll with pressure in the state of being melted upon application of heat. Therefore, preventing a phenomenon (hot offset phenomenon) in which the toner image partially adheres to the surface of the heat roll and contaminates a following medium a toner image is fixed on. In addition, a separator such as a separation click or an oil applicator is formed on the roll to prevent the medium such as a paper from winding around the roll when passing the roll. However, recent copiers or printers being downsized mostly use oilless fixing methods without the oil applicator, and in which the conventional heat roll methods cause a separation failure unless the fixer and the toner are tailored.

Methods of including a large amount of a wax such as polypropylene and polyethylene in a toner to improve the releasability thereof melted with heat, and methods of coating the surface of the heat roll with a resin having good separativeness such as a fluorochemical resin are disclosed. However, the wax such as polypropylene and polyethylene has low compatibility with a polyester resin having a high polarity, which is used for preparing a toner, and is difficult to fill therein in a large amount. In order to solve this problem, a method of using a modified wax such as an oxidized polyolefin wax having a polar group at its molecular end to improve the compatibility of the wax with the polyester resin and increase the dispersibility and a mount thereof filled in a toner. However, the modified wax has a higher viscosity than an unmodified wax although having improved dispersibility and a dispersion diameter thereof is so small that the releasability thereof deteriorates, resulting in occurrence of hot offset phenomenon.

Particularly, color toners noticeably have the hot offset and separativeness problems. Namely, the color toner needs to have higher melting performance with heat and lower viscosity than a black toner to have gloss, transparency and color reproducibility. However, a color toner including a resin satisfying such requirements possibly deteriorates in intermolecular cohesion when melted with heat and adheres to the heat roll more when passing the heat roll, resulting in noticeable occurrence of the separation failure and hot offset. In order to prevent the separation failure and hot offset, a wax is filled in a toner in a large amount to reduce adherence of the toner to the heat roll. However, a large amount of the wax causes a larger dispersion diameter thereof and free waxes increase, resulting in image noise.

Recently, the dispersion diameter of a wax in a toner is specified to solve the above-mentioned problems.

Japanese Patent No. 3458629 discloses a nonmagnetic toner for forming a full-color image containing at least a resin binder, a colorant and wax particles having a particle size distribution in which wax particles having not less than 3 μm not 3% or less by number, wax particles having 2 to less than 3 μm for 12% or less by number, wax particles having 1 to less than 2 μm 5 to 30% by number and wax particles having less than 1 μm 55 to 95% by number. Japanese Published Unexamined Patent Application No. 2004-126268 discloses a toner composition consists essentially of a binder resin, two waxes incompatible with the binder resin and a colorant, and in the number-particle size distribution of dispersion particle diameter of each wax, the standard deviation is not less than 0.4 and less than 2.0, the top peak is present between 1.0 and 1.5 μm, the number proportion of wax particles of not less than 1.0 and less than 1.5 μm is not less than and less than 40%, and the number proportion of wax particles of not less than 2.5 μm is less than 20%. However, the toner of Japanese Patent No. 3458629 includes the wax having a very small dispersion diameter and does not have satisfactory separativeness in oilless fixing. The toner of Japanese Published Unexamined Patent Application No. 2004-126268 including two waxes is likely to have a broad dispersion diameter distribution of the wax and difficult to have a sharp dispersion diameter distribution thereof. Therefore, a toner needs to be filled with a large amount of the wax to have good separativeness and is very difficult to have both thermostable storage stability and a prohibitive power of free wax.

Because of these reasons, a need exists for a toner for a non-magnetic one-component developer, having good separativeness, a prohibitive power of free wax and thermostable storage stability.

SUMMARY OF THE INVENTION

Accordingly, an object of the present invention is to provide a toner for a non-magnetic one-component developer, having good separativeness, a prohibitive power of free wax and thermostable storage stability.

Another object of the present invention is to provide a method of preparing the toner.

A further object of the present invention is to provide a developer including the toner.

Another object of the present invention is to provide an image forming method using the toner or the developer.

A further object of the present invention is to provide an image forming method of using the toner or the developer to form a toner image, and using an oilless fixing method for fixing the toner image.

Another object of the present invention is to provide a process cartridge using the toner.

These objects and other objects of the present invention, either individually or collectively, have been satisfied by the discovery of a toner for a non-magnetic one-component developer, comprising:

a binder resin;

a wax present dispersing in the toner in the shape of a particle; and a colorant, wherein the wax having a particle diameter not less than 2.0 μm and less than 3.0 μm is not less than 20% and less than 40% by number based on total number thereof; the wax has a mode value not less than 1.5 μm and less than 2.0 μm in a frequency distribution of 0.1 μm width; and the following relationship is satisfied:

$$45<XZ/Y<62$$

wherein X represents a softening point (° C.) of the toner; Y represents a volume-average particle diameter (μm) of the toner; and Z represents a total parts by weight of the wax included in 100 parts by weight of the toner.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
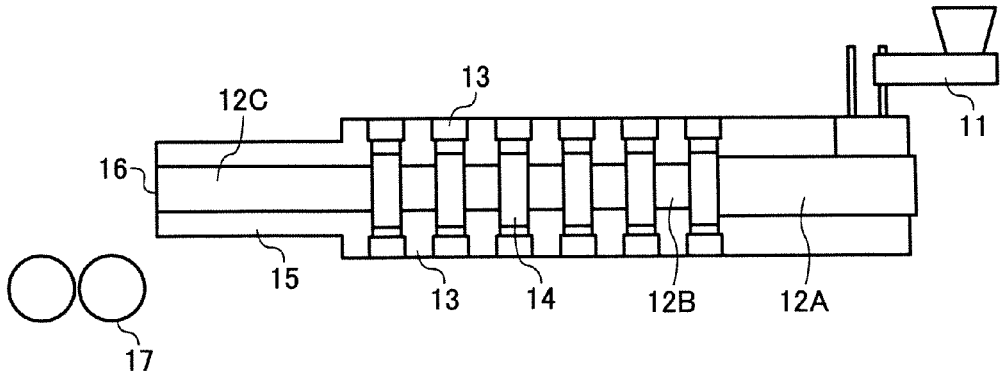
FIG. 1 is a schematic view illustrating a grind kneader suitable for preparing the toner of the present invention.

The present invention provides a toner for a non-magnetic one-component developer, having good separativeness, a prohibitive power of free wax and thermostable storage stability.

More particularly, the present invention relates to a toner for a non-magnetic one-component developer, comprising:

a binder resin;

a wax present dispersing in the toner in the shape of a particle; and a colorant, wherein the wax having a particle diameter not less than 2.0 μm and less than 3.0 μm is not less than 20% and less than 40% by number based on total number thereof; the wax has a mode value not less than 1.5 μm and less than 2.0 μm in a frequency distribution of 0.1 μm width; and the following relationship is satisfied:

$$45<XZ/Y<62$$

wherein X represents a softening point (° C.) of the toner; Y represents a volume-average particle diameter (μm) of the toner; and Z represents a total parts by weight of the wax included in 100 parts by weight of the toner.

Particularly, it is preferable that the wax having a specific particle diameter is finely dispersed in the binder resin beforehand. The toner of the present invention can be prepared by melting and kneading toner constituents such as a binder resin, a wax and a colorant to prepare a kneaded mixture, cooling the kneaded mixture to prepare a cooled mixture, pulverizing the cooled mixture to prepare a pulverized mixture, and classifying the pulverized mixture. Not only the final toner has the particle diameter distribution of the wax of the present invention, but also the kneaded mixture does.

The wax in the toner of the present invention preferably has a specific dispersion diameter. The dispersion diameter is slightly larger than those of conventional toners, and the wax comparatively has a sharp particle diameter distribution and the content thereof in the toner can be controlled. Therefore, the toner of the present invention has good separativeness even in oilless fixing and does not have a free wax filming over photoreceptors or adhering to a developing blade.

The wax in the non-magnetic toner of the present invention preferably has a mode value not less than 1.5 μm and less than 2.0 μm in a frequency distribution of 0.1 μm width. When less than 1.5 μm, the separativeness deteriorates. When not less than 2.0 μm, the wax adheres to the developing blade more.

In addition, the wax having a particle diameter not less than 2.0 μm and less than 3.0 μm is essentially not less than 20% and less than 40% by number based on total number thereof. When less than 20%, the separativeness in oilless fixing deteriorates. When not less than 40%, the wax adheres to the developing blade more.

Further, the following relationship is essentially satisfied:

$$45<XZ/Y<62$$

wherein X represents a softening point (° C.) of the toner; Y represents a volume-average particle diameter (μm) of the toner; and Z represents a total parts by weight of the wax included in 100 parts by weight of the toner.

When the softening point of the toner is too low, the separativeness thereof deteriorates. When too high, the image glossiness deteriorates. When the volume-average particle diameter of the toner is too small, the developability thereof deteriorates. When too large, the resultant image quality deteriorates. When total amount of the wax in the toner is too small, the separativeness of the toner deteriorates. When too large, the wax adheres to a regulation blade of an image forming apparatus. Therefore, X, Y and Z need to be optimized and the above-mentioned relationship is essentially satisfied. When XZ/Y is 45 or less, the resultant image quality deteriorates. When 62 or more, a balance between the adherence to the regulation blade of the wax and the oilless fixability of the toner deteriorates.

The volume-average particle diameter of the toner is measured by Coulter Multisizer from Beckman Coulter, Inc. with an aperture tube of 100 μm. Specifically, the particle diameters of the toner from about 2 to 20 μm are minutely divided by about 16 to 32, and the volume ratios thereof are bargraphed to make a particle diameter distribution and the average thereof is determined as the volume-average particle diameter.

In addition, in order not to occur the image noise and adherence to the developing blade of the wax due to the free wax, 20% by number of the wax preferably has a particle diameter not less than 2.5 μm. Further, in order that a toner has good separativeness against environmental variations in the oilless fixing system, not less than 35% and less than 45% by number of the wax preferably has a particle diameter not less than 1.5 μm and less than 2.0 μm.

Further, XZ is preferably greater than 400 and less than 540 in terms of the separativeness, adherence to the regulation blade and image glossiness. When XZ is 400 or less, the separativeness deteriorates. When 540 or more, the adherence to the regulation blade is likely to occur and the image glossiness deteriorates.

In the present invention, the wax having the specific particle diameters included in the toner makes the toner have good separativeness even in an oilless fixing system not applying an oil in fixing. Regulating a ratio of the wax included in the toner prohibits the wax from being exposed or projecting on the surface of the toner, which prevents the wax from leaving from the toner when stirred, etc. In the present invention, an amount of the wax in the toner need not be increased than necessary to maintain the separativeness of the toner, which prevents members such as a photoreceptor, an intermediate transferer and a developing sleeve from being contaminated with the wax, and the members have longer lives and quality images are produced for long periods.

In the present invention, the average dispersion diameter of the wax is a number-average dispersion diameter. Specifically, a toner buried in an epoxy resin is ultra-thin sliced to have a thickness about 100 μm and dyed with ruthenium tetroxide to observe with a transmission electron microscope at 10,000 magnifications. 100 pieces of the wax particles are randomly photographed to determine particle diameter distribution in number at a unit of 0.1 μm wide. When the wax has the shape of a spindle, the diameter thereof is a half of the sum of long and short axes of the wax.

The non-magnetic toner of the present invention is typically prepared by melting and kneading a hybrid binder resin including a finely-dispersed wax, a colorant, etc. to prepare a kneaded mixture, cooling the kneaded mixture to prepare a cooled mixture, pulverizing the cooled mixture to prepare a pulverized mixture, and classifying the pulverized mixture. The dispersion diameter of the wax is controlled by a kneader and kneading conditions. Grind kneaders kneading materials between outer grind heads and inner grind heads upon application of rotation shearing strength are preferably used. The rotation shearing strength is controlled by adjusting a gap between the outer grind heads and inner grind heads. The kneaded mixture is extruded to be cooled in the present invention.

The gap between the outer grind heads and inner grind heads is preferably from 0.05 to 5 mm, and more preferably from 0.1 to 2 mm. The gap can be adjusted as desired at an interval of 0.05 mm from 0.1 to 3 mm.

FIG. 1 is a schematic view illustrating a grind kneader suitable for preparing the toner of the present invention. Toner constituents are fed from a feeder 11, pass through a screw 12A and are kneaded between outer grind heads 13 and inner grind heads 14. After passing through a transport path 12B, the kneaded mixture passes through a screw 12C in a cylinder 15 and is discharged from an outlet 16 to be extended upon application of pressure and cooled with a press roller 17. Kneading conditions are controlled by selecting the gap between the outer grind heads 13 and inner grind heads 14, an inner temperature and rotation number of the screws.

Typically, when the gap between the outer grind heads 13 and inner grind heads 14 becomes smaller, the wax has a smaller particle diameter. When the gap becomes larger, the wax has a larger particle diameter.

The gap between the outer grind heads 13 and inner grind heads 14 is furthermore preferably from 0.25 to 0.80 mm in the present invention.

The cylinder preferably has an inner temperature not less than a softening point of the binder resin, and more preferably higher by about 10° C. in consideration of dispersion of the wax and colorant. Specifically from 60 to 180° C., and more preferably from 70 to 140° C. The softening point is a softening point of a mixed resin when two or more resin are mixed and that of a binder resin including a wax when included in the binder resin.

The rotation number of screws are preferably from 50 to 100 rpm, and more preferably from 60 to 90 rpm for a suitable torque.

Specific examples of the wax for use in the present invention include known waxes, e.g., polyolefin waxes such as polyethylene wax and polypropylene wax; long chain hydrocarbons such as a paraffin wax and a sasol wax; and waxes including a carbonyl group. Specific examples of the waxes including a carbonyl group include ester polyalkanates such as a carnauba wax, a montan wax, trimethylolpropanetribehenate, pentaerythritoltetrabehenate, pentaerythritoldiacetatedibehenate, glycerinetribehenate, and 1,18-octadecanedioldistearate; polyalkanolesters such as tristearyltrimelliticate and distearylmaleate; amide polyalkanates such as ethylenediaminedibehenylamide; polyalkylamides such as tristearylamidetrimelliticate; and dialkylketones such as distearylketone.

The toner for non-magnetic one-component developer for use in the present invention preferably includes a paraffin wax.

The paraffin wax has a viscosity lower than those of other waxes and easily exude on the surface of the toner. Therefore, the toner can include the paraffin wax in a minimum amount required.

The toner of the present invention preferably includes one kind of wax because the particle diameter thereof can be more controllable.

In the present invention, the wax preferably has a melting point of from 70 to 80° C. When lower than 70° C., the heat resistance of the resultant toner deteriorates. When higher than 80° C., the glossiness and low-temperature fixability thereof deteriorates. The melting point of the wax is determined from a peak temperature on a DSC curve thereof. In the present invention, a differential scanning calorimeter DSC-200 from Seiko Instruments Inc. is used to measure the melting point, but the measurer is not limited thereto if a DSC curve is obtainable.

The toner of the present invention preferably includes a wax in an amount of from 3.2 to 3.8% by weight based on total weight of the binder resin and the wax. When less than 3.2% by weight, the separativeness of the toner deteriorates in oilless fixing. When greater than 3.8% by weight, a free wax causes image noises.

In the present invention, as mentioned above, one kind of wax is preferably used in terms of dispersibility, but two or more waxes may be used. When two or more waxes are used, total weight of the waxes is in the above-mentioned range. A mixture of the waxes satisfies the particle diameter distribution and melting point.

The binder resins are not limited, and may be known resins such as polyester resins, (meth)acrylic resins, styrene-(meth) acrylic copolymer resins, epoxy resins and cyclic olefin resins, e.g., TOPAS-COC from Ticona. A hybrid resin formed of a polycondensation polymeric skeleton and a vinyl polymeric skeleton is preferably used in the oilless fixing system.

The polyester resin is typically formed by polycondensation between a polyol and a polycarboxylic acid. Specific examples of diols in the polyols include adducts of a bisphenol A such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane; ethylene glycol; diethylene glycol; triethylene glycol; 1,2-propylene glycol; 1,3-propylene glycol; 1,4-butadieneol; neo-pentyl glycol; 1,4-butenediol; 1,5-pentanediol; 1,6-hexanediol; 1,4-cyclohexanedimethanol; dipropyleneglycol; polyethyleneglycol; polytetramethyleneglycol; bisphenol A; hydrogenated bisphenol A; etc.

Specific examples of tri- or more valent alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxybenzene, etc.

Specific examples of dicarboxylic acids in the polycarboxylic acids include a maleic acid, a fumaric acid, a citraconicacids, anitaconicacid, aglutaconicacid, aphthalic acid, an isophthalic acid, a terephthalic acid, a cyclohexane dicarboxylic acid, a succinic acid, an adipic acid, a sebacic acid, an azelaic acid, a malonic acid, a n-dodecenylsuccinic acid, an isododecenylsuccinic acid, a n-dodecylsuccinic acids, an isododecylsuccinic acid, a n-octenylsuccinic acid, an isooctenylsuccinic acid, a n-octylsuccinic acid, an isooctylsuccinic acid, their anhydrides or lower alkyl esters, etc.

Specific examples of tricarboxylic acids include a 1,2,4-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, 1,3-dicarboxyl-2-methyl-methylenecarboxypropane, tetra(methylenecarboxyl)methane, a 1,2,7,8-octantetracarboxylic acid, an empol trimer acid, and their anhydrides and lower alkyl esters, etc.

In the present invention, a hybrid resin formed of a polycondensation polymeric skeleton and a vinyl polymeric skeleton is preferably used, which is prepared by a combination of a polycondensation reaction forming a polyester resin and a radical polymerization reaction forming a vinyl resin in a same container, using a mixture of a polycondensated resin material monomer, a vinyl resin material monomer and a monomer reacting with the both material monomers. The monomer reacting with the both material monomers is, i.e., a monomer usable in both of the polycondensation reaction and radical polymerization reaction. Namely, the monomer is a monomer having a polycondensation-reactable carboxyl group and a radical-polymerization-reactable vinyl group such as a fumaric acid, a maleic avid, an acrylic acid and a methacrylic acid.

The polycondensated resin material monomer includes the above-mentioned polyols, polycarboxylic acids, etc.

The vinyl material monomer includes styrenes or their derivatives such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins such as ethylene, propylene, butylene and isobutylene; methacrylate alkyl esters such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate and dodecylmethacrylate; acrylate alkyl esters such as methylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate and dodecylacrylate; unsaturated carboxylic acids such as an acrylic acid, a methacrylic acid, an itaconic acid and a maleic acid; acrylonitrile; maleate ester; itaconate ester; vinylchloride; vinylacetate; vinylbenzoate; methylvinylketone; ethylvinylketone; hexylvinylketone; methylvinylether; ethylvinylether; isobutylvinylether; etc.

Specific examples of a polymerization initiator for polymerizing the vinyl resin material monomer include azo or diazo polymerization initiators such as 2,2'-azobis(2,4-dimethylvaleronitrile), 2,2'-isobutyronitrile, 1,1'-azobis(cyclohexane-1-carbonitrile) and 2,2'-azobis-4-methoxy-2,4-dimethylvaleronitrile; and peroxide polymerization initiators such as benzoylperoxide, dicumylperoxide, methylethylketoneperoxide, isopropylperoxycarbonate and lauroylperoxide.

The binder resin preferably has an acid value of from 5 to 50 KOH mg/g, and more preferably from 10 to 40 KOH mg/g. Particularly, a polyester resin having such an acid value improves the dispersibility of a colorant and forms a toner having good chargeability.

In the present invention, two or more binder resins having different softening points are preferably used in terms of improving the separativeness and offset resistance of the resultant toner in the oilless fixing system. Typically, a first binder resin having a softening point of from 100 to 120° C., preferably from 105 to 115° C., and a second binder resin having a softening point of from 130 to 150° C., preferably from 135 to 150° C. are preferably used. In addition, the first binder resin and second binder resin preferably have a glass transition temperature of from 50 to 75° C. and 60 to 75° C., respectively in terms of heat resistance of the resultant toner. When two or more binder resins are used, a mixed resin thereof has the above-mentioned acid value.

The first binder resin is preferably a polyester resin prepared by polycondensating an adduct of bisphenol A with alkyleneoxide as the polyol, and a terephthalic acid and a fumaric acid as the polycarboxylic acid.

The second binder resin is a vinyl polyester resin prepared by using an adduct of bisphenol A with alkyleneoxide, a terephthalic acid, a trimellitic acid and a succinic acid as the polyester resin material monomer; styrene and butylacrylate as the vinyl resin material monomer; and a fumaric acid as the monomer reactive with both of the material monomers.

A hybrid resin formed of a polycondensation polymeric skeleton and a vinyl polymeric skeleton is preferably used as the second binder resin, which is prepared by a combination of a polycondensation reaction forming a polyester resin and a radical polymerization reaction forming a vinyl resin in a same container, using a mixture of a polyester resin material monomer, a vinyl resin material monomer and a monomer reacting with the both material monomers. Such a resin is preferably used in terms of improving dispersiblity of the wax, toughness, fixability and offset resistance of the resultant toner. In this case, the vinyl resin material monomer preferably has a ratio of from 5 to 30% by weight, and more preferably from 10 to 25% by weight based on total weight of the monomers.

The first binder resin preferably includes a tetrahydrofuran (THF)-insoluble component in an amount of from 0.1 to 30% by weight, and more preferably from 0.1 to 30% by weight in terms of hot offset resistance of the resultant toner.

The second binder resin preferably has a ratio of from 40 to 65% by weight based on the weight of the first binder resin in terms of separativeness and glossiness of the resultant toner.

In the present invention, the wax is preferably included in the binder resin when synthesized. Namely, the binder resin forming monomers including the wax are polymerized. Particularly when the above-mentioned first (low-molecular-weight) binder resin and second (polymeric) resin are combined, the wax is preferably included in the second binder resin when synthesized because the wax is more difficult to disperse therein than in the first binder resin. Specifically, the acid monomer, alcohol monomer and optional vinyl rein material monomer including the wax are polycondensated (radically polymerized when desired).

In the present invention, the wax is preferably dispersed in the hybrid resin so as to have an average dispersion diameter of from 3 to 5 μm. When greater than 5 μm or less than 3 μm, the wax is difficult to have the dispersion status of the present invention. The former causes the adherence of the wax to the developing blade, and the latter deteriorates the separativeness of the resultant toner.

Known colorants and dyes conventionally used in toners for developing an electrostatic latent image can be used as the colorant in the present invention. Specific examples of the colorant include carbon black, Aniline Blue, calcoil blue, chrome yellow, ultramarine blue, Dupont Oil Red, QUINOLINE YELLOW, Methylene blue-chloride, Copper Phthalocyanine, Malachite Green Oxalate, lamp black, Rose Bengal, C.I. Pigment Red 48:1, C.I. Pigment Red 122, C.I. Pigment Yellow 97, C.I. Pigment Yellow 12, C.I. Pigment Yellow 17, C.I. Pigment Yellow 74, C.I. Solvent Yellow 162, C.I. Pigment Yellow 180, C.I. Pigment Yellow 185, C.I. Pigment Blue 15:1,C.I. Pigment Blue 15:3, etc. The colorant has a ratio of from 2 to 10% by weight based on total weight of the binder resin (including the wax when included therein).

The colorant is preferably dispersed in a mixed binder resin of the first and second binder resins in the form of a masterbatch in terms of dispersibility thereof in the toner. The masterbatch includes the colorant so as to have the above-mentioned weight ratio.

The toner for non-magnetic one-component developer of the present invention may include additives such as a charge controlling agent. Specific examples of the charge control agents include known charge control agents conventionally used in toners for developing an electrostatic latent image such as fluorochemical surfactants, salicylic acid metal complexes, metal-containing dyes such as azoic metal compounds, polymeric acids such as a copolymer including a maleic acid as a monomeric component, calixarene compounds, organic boron compounds, etc.

In the present invention, an inorganic particulate material is preferably used as an external additive to support the fluidity, developability and chargeability of the resultant toner. The inorganic particulate material preferably has a specific surface area of from 20 to 500 $m^2/g$ when measured by a BET method, and an average primary particle diameter of from 2 nm to 2 μm, and more preferably from 5 nm to 500 mμ. The toner preferably includes the inorganic particulate material in an amount of from 0.01 to 5% by weight, and more preferably from 0.01 to 2.0% by weight. Specific examples of the inorganic particulate material include silicon oxide, zinc oxide, tin oxide, quartz sand, titanium oxide, clay, mica, sand-lime, diatomearth, chromium oxide, cerium oxide, rediron oxide, antimony trioxide, magnesium oxide, zirconium oxide, barium sulfate, barium carbonate, calcium carbonate, silicon carbide, silicon nitride, etc.

The toner for non-magnetic one-component developer of the present invention preferably has a softening point of from 125 to 134° C. When lower than 125° C., the toner deteriorates in separativeness and adheres to a developing blade more. When higher than 134° C., the resultant images deteriorate in glossiness.

In addition, the toner for non-magnetic one-component developer preferably has a volume-average particle diameter of form 6 to 10 μm, and more preferably form 7 to 9 μm.

The developer of the present invention includes the toner for non-magnetic one-component developer of the present invention. Therefore, the developer is free from filming over a photoreceptor and adherence to a developing blade caused by a wax in a one-component system using an oilless fixer.

The image forming method of the present invention is a method of forming an image with the non-magnetic toner or the developer of the present invention. The image has good separativeness from a fixer.

A recording sheet such as a paper on which a toner image formed with the non-magnetic toner or the developer of the present invention is formed is passes through a pressure-applied contact point between a heating member and a pressure member (or heat and pressure members) under an oilless fixing method. The surface of the heating member is preferably formed of fluorochemical resins such as tetrafluoroethylene-perfluoroalkylvinylether (PFA), polytetrafluoroethylene (PTFE) and polyvinylidene-fluoride.

Figure 2:
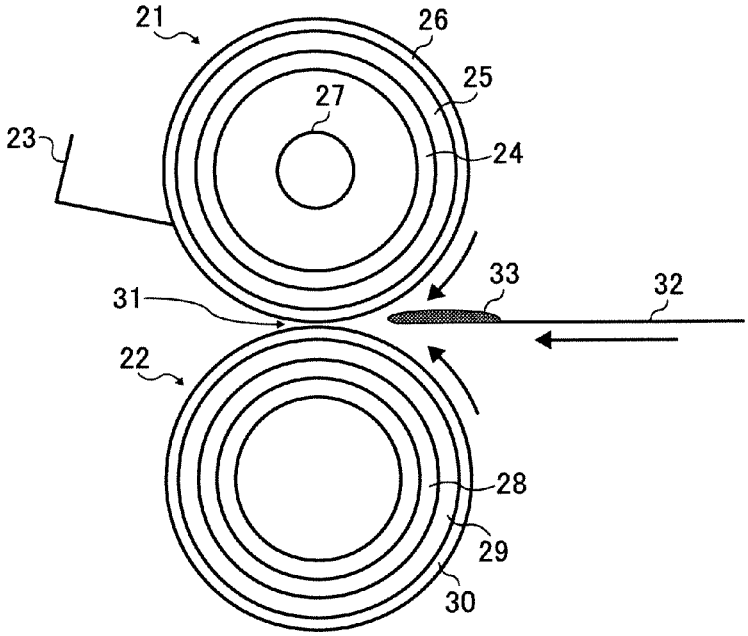
FIG. 2 is a schematic view illustrating a fixer suitable for fixing the toner of the present invention.

FIG. 2 is a schematic view illustrating a fixer suitable for fixing the toner of the present invention. The fixer in FIG. 2 includes a heat roller 21 as a heating member and a pressure roller 22 as a pressure member, and further includes a separation plate separating a recording sheet on which a toner image is fixed from the heat roller 21. The heat roller 21 typically includes an elastic layer 25 and a surface layer 26 on an aluminum core metal 24 including a heater 27. The pressure roller 22 typically includes an elastic layer 29 and a surface layer 30 on an aluminum core metal 28. The materials of the elastic layers 25 and 29 are not limited, but a silicone rubber is preferably used therefor. The materials of the surface layers 26 and 30 are not limited, but a fluorochemical resin, particularly PFA is preferably used therefor.

In FIG. 2, a nip 31 is formed at a pressure-applied contact point between the heat roller 21 and pressure roller 22. The nip 31 is preferably convex upward in terms of the separativeness of the on which a toner image is fixed, which prevents a recording sheet 32 from winding around the heat roller 21. The recording sheet 32 bearing a toner image 22 passes through the pressure-applied contact point from right to left to fix the toner image thereon.

A process cartridge of the present invention includes at least a photoreceptor, an image developer including the toner of the present invention and one of a charger and a cleaner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Hybrid Resin

Styrene (St) and butylacrylate (BA) as vinyl monomers and Dicumylperoxide (DCP) as a polymerization initiator were placed in a dripping funnel under the formulation shown in Table 1. Next, an adduct of bisphenol A with ethylene oxide (BPA-EO) and an adduct of bisphenol A with propylene oxide (BPA-PO) as alcohols of polyester resin monomers; an acrylic acid (AA), a succinic acid derivative (DSA), a fumaric acid (FA), a trimellitic acid (TMA) and a terephthalic acid (TPA) as acids; and a dibutylperoxide (DBO) as an esterification catalyst were placed in a glass four-neck flask having a thermometer, a stainless stirrer, a falling condenser and a nitrogen inlet tube under the formulation (Table 1) according to a base resin (resin A). Further, after a wax was placed therein in an amount shown in Table 2, the vinyl monomers and polymerization initiator was dropped in the flask under a nitrogen atmosphere in a mantle heater while heated and stirred. Then, after the mixture was maintained at a constant temperature and the addition polymerization reaction was completed, and the mixture was heated again to be subjected to a polycondensation reaction. The reaction was followed by measuring a softening point of the mixture. The reaction was stopped when the mixture had a predetermined softening point, and the mixture was cooled to have a room temperature to prepare a complex polyester-resin AW.

As the complex polyester resin AW was prepared, complex polyester resins BWI to BWIV, CW, EW, FW and GW were prepared using base resins B, C, E, F and G formed of vinyl resin monomers and polyester resin monomers shown in Tables 1-1 and 1-2 and waxes shown in Table 2.

In table 1-1, PC represents polycondensation.

In Table 1-2, PI represents polymerization initiator, EHA represents 2-ethylhexylacrylate monomer and AIBN represents azobisisobutylnitrile ($C_8H_{12}N_4$) polymerization catalyst.

In Table 2, 73 para represents a paraffin wax having a melting point of 73° C., 78 natural represents a carnauba wax having a melting point of 78° C., 67 para represents a paraffin wax having a melting point of 67° C., 82FT represents a Fischer Tropsh wax having a melting point of 82° C. and PP represents a polypropylene wax having a melting point of 130° C. The content of the wax is a weight ratio thereof to total weight of the monomers and wax used for preparing the resin.

Synthesis of Resin

The procedures for preparation of the hybrid resin were repeated to prepare resins D1 and D2 by the formulations shown in Table 1 except for not using the vinyl resin monomer, polymerization initiator and wax.

The softening point Tm and glass transition temperature Tg of each resin are shown in Tables 1 and 2.

Tm is measured as follows:

1.0 g of a sample is placed in flow tester CFT-500 from Shimadzu Corp. using a die having a diameter of 0.5 mm and a height of 1.0 mm, and a temperature at a half of the sample flowed at a programming speed of 3.0° C./min, preheating time of 3 min, a load of 30 kgs from 40 to 140° C. is determined as Tm.

Tg is measured as follows.

Precisely 10 mg of a sample is placed in an aluminum pan of a differential scanning calorimeter DSC-200 from Seiko Instruments Inc., and the samples heated up to 200° C. from a room temperature at a programming speed of 30° C./min and cooled. Next, the temperature is measured from 20 to 120° C. at a programming speed of 10° C./min. A shoulder value of the main endothermic peak from 30 to 90° C. in the heating process is Tg. Alumina is placed in aluminum pan as a reference.

TABLE 1-1

| | PC | | | | | | | |
|---|---|---|---|---|---|---|---|---|
| | Alcohol (mol) | | Acid (mol) | | | | | Catalyst (mmol) |
| | BPA•EO | BPA•PO | AA | DSA | FA | TMA | TPA | DBO |
| Resin A | 0.2 | 2.0 | 0.3 | 0.2 | 0.2 | 0.3 | 1.0 | 12 |
| Resin B | — | 2.2 | 0.4 | 0.2 | — | 0.4 | 1.0 | 12 |
| Resin C | — | 2.2 | 0.5 | — | 0.1 | 0.5 | 1.0 | 12 |
| Resin D1 | 2.4 | 2.3 | — | 0.6 | 1.2 | 1.2 | 1.7 | 24 |
| Resin E | — | 2.2 | 0.4 | 0.2 | 0.2 | 0.2 | 1.0 | 12 |
| Resin F | 0.2 | 2.0 | 0.3 | 0.2 | 0.3 | 0.2 | 1.0 | 12 |
| Resin G | — | 2.2 | 0.5 | — | — | 0.6 | 1.0 | 12 |
| Resin D2 | 2.4 | 2.3 | — | 0.6 | 1.2 | 1.0 | 1.9 | 24 |

TABLE 1-2

| Vinyl | | | | | | |
|---|---|---|---|---|---|---|
| Monomer (mol) | | | PI (mol) | | | |
| St | EHA | BA | AIBN | DCP | Tm (° C.) | Tg (° C.) |
| 4.0 | — | 0.4 | — | 0.1 | 137.4 | 66.9 |
| 3.9 | 0.5 | — | 0.1 | — | 146.6 | 67.5 |
| 3.9 | 0.4 | — | — | 0.1 | 148.2 | 67.7 |
| — | — | — | — | — | 109.3 | 67.4 |
| 3.9 | 0.5 | — | 0.1 | — | 143.7 | 67.2 |
| 3.9 | 0.1 | 0.4 | — | 0.1 | 135.9 | 66.8 |
| 3.9 | 0.4 | — | — | 0.1 | 149.8 | 67.8 |
| — | — | — | — | — | 106.7 | 67.4 |

TABLE 2

| | Base resin | Wax | Wax content | Tm (° C.) | Tg (° C.) |
|---|---|---|---|---|---|
| Resin AW | Resin A | 73 (para) | 6.5% | 137.3 | 67.0 |
| Resin BWI | Resin B | | | 146.5 | 67.4 |
| Resin BWII | | 78 (natural) | | 146.6 | 67.5 |
| Resin BWIII | | 82FT | | 146.7 | 67.5 |
| Resin BWIV | | 67 (para) | | 146.4 | 67.3 |
| Resin CW | Resin C | 73 (para) | 8.0% | 148.1 | 67.6 |
| Resin EW | Resin E | | 6.0% | 143.7 | 67.1 |
| Resin FW | Resin F | | 6.5% | 136.0 | 66.7 |
| Resin GW | Resin G | | 5.8% | 149.9 | 67.8 |

Each of the resins was crushed to have a particle diameter not grater than 1 mm and used for preparation of a toner under the following formulation.

| | |
|---|---|
| C.I. Pigment Red 57-1 (from Fuji Pigment Co., Ltd.) | 50 |
| Binder Resin | 50 |
| Water | 30 |

The above-mentioned materials were mixed with a HENSCHEL MIXER to prepare a mixture. The mixture was kneaded with a two-roll mixer having a surface temperature of 130° C. for 1 hr, and cooled to harden to prepare a solid material. The solid material was pulverized with a pulverizer to prepare a masterbatch having a diameter of 1 mm.

Example 1

54 parts of the resin BWI and 46 parts of the resin D1 were mixed to prepare a binder resin as shown in Table 3. After a masterbatch including 100 parts of the binder resin (including a wax) and 4.0 parts of C.I. Pigment Red 57-1 was mixed with a HENSCHEL MIXER, the mixture was melted and kneaded with a grind kneader as shown in FIG. 1 at a gap between the outer and inner grind head of 0.50 mm, an inner cylinder temperature of 100° C. and a screw revolution of 80 rpm. The kneaded mixture was extended upon application of pressure with a cooling press roller to prepare a solid mixture having a thickness of 2 mm. The solid mixture was transferred with a belt to be crushed with a feather mill. Then, the crushed mixture was pulverized with a jet pulverizer IDS from Nippon Pneumatic Mfg. Co., Ltd. to have a volume-average particle diameter of 8 μm and classified with a classifier DSX from to Nippon Pneumatic Mfg. Co., Ltd. to prepare a parent toner having a volume-average particle diameter of 8.5 μm.

100 parts of the parent toner, 1.0 part of a hydrophobic silica R974 from Nippon Aerosil Co., Ltd., 1.0 part of a hydrophobic silica AEROSIL 90G from Nippon Aerosil Co., Ltd., treated with hexamethylenedisilazane, having a BET specific surface area of 65 $m^2/g$, pH of 6.0 and a hydrophobicity not less than 65% were mixed with a HENSCHEL MIXER at a peripheral speed of 40 m/sec for 90 sec, and sieved with a sieve having an opening of 75 μm to prepare a toner.

Examples 2 to 14 and Comparative Examples 1 to 9

The procedure for preparation of the toner in Example 1 was repeated except for changing the binder resins, the mixing ratio thereof, wax, the content thereof and kneading conditions as shown in Tables 3-1 and 3-2.

The dispersion status of the wax in the toner is shown in Table 3-1. The toner properties are shown in Table 4. The dispersion status of the wax in the toner, X: softening point of the toner (Tm) (° C.) and Y: volume-average particle diameter (μm) were measured by the above-mentioned methods. The mode value "1.7/1.8" means that the mode value is between 1.7 and 1.8 μm.

TABLE 3-1

| | Wax Dispersion Diameter | | | |
|---|---|---|---|---|
| | 1.5 to 2 μm Number (%) | Mode Value μm | 2.5 μm or more Number (%) | 2 to 3 μm Number (%) |
| Example 1 | 40.0 | 1.7/1.8 | 6.0 | 25.0 |
| Example 2 | 33.0 | 1.8/1.9 | 22.0 | 38.0 |
| Example 3 | 36.0 | 1.7/1.8 | 22.0 | 38.0 |
| Example 4 | 46.0 | 1.7/1.8 | 6.0 | 27.0 |
| Example 5 | 33.0 | 1.5/1.6 | 5.0 | 23.0 |
| Example 6 | 35.0 | 1.7/1.8 | 7.0 | 30.0 |
| Example 7 | 41.0 | 1.8/1.9 | 10.0 | 37.0 |
| Example 8 | 36.0 | 1.6/1.7 | 6.0 | 22.0 |
| Example 9 | 36.0 | 1.7/1.8 | 8.0 | 21.0 |
| Example 10 | 37.0 | 1.7/1.8 | 7.0 | 29.0 |
| Example 11 | 35.0 | 1.7/1.8 | 9.0 | 30.0 |
| Example 12 | 35.0 | 1.6/1.7 | 6.0 | 20.0 |

TABLE 3-1-continued

| | Wax Dispersion Diameter | | | |
|---|---|---|---|---|
| | 1.5 to 2 μm Number (%) | Mode Value μm | 2.5 μm or more Number (%) | 2 to 3 μm Number (%) |
| Example 13 | 35.0 | 1.8/1.9 | 10.0 | 37.0 |
| Example 14 | 35.0 | 1.6/1.7 | 6.0 | 20.0 |
| Comparative Example 1 | 7.0 | 0.9/1.0 | 36.8 | 23.0 |
| Comparative Example 2 | 17.0 | 0.6/0.8 | 5.0 | 17.0 |
| Comparative Example 3 | 15.0 | 0.6/0.7 | 5.0 | 8.0 |
| Comparative Example 4 | 26.0 | 1.0/1.1 | 4.0 | 6.0 |
| Comparative Example 5 | 8.0 | 3.7/3.8 | 79.0 | 29.0 |
| Comparative Example 6 | 33.0 | 1.3/1.4 | 5.0 | 15.0 |
| Comparative Example 7 | 14.0 | 3.1/3.2 | 65.0 | 35.0 |
| Comparative Example 8 | 25.0 | 1.4/1.5 | 21.0 | 24.0 |
| Comparative Example 9 | 22.0 | 1.1/1.2 | 19.0 | 20.0 |

TABLE 3-2

| | Resin | | | | Kneading conditions | | |
|---|---|---|---|---|---|---|---|
| | H/L | Wax | Average dispersion diameter of wax (μm) | Wax content in H (%) | Screw (rpm) | Gap (mm) | Cylinder Temperature (° C.) |
| Example 1 | 54BWI/46D1 | 73 | 3.8 | 6.5 | 80 | 0.5 | 100 |
| Example 2 | 54BWI/46D1 | 73 | 3.8 | 6.5 | 90 | 0.7 | 140 |
| Example 3 | 54BWI/46D1 | 73 | 3.8 | 6.5 | 80 | 0.6 | 130 |
| Example 4 | 54BWI/46D1 | 73 | 3.8 | 6.5 | 90 | 0.3 | 80 |
| Example 5 | 54BWI/46D1 | 73 | 3.8 | 6.5 | 80 | 0.5 | 80 |
| Example 6 | 54BWII/46D1 | 78 | 3.7 | 6.5 | 90 | 0.5 | 120 |
| Example 7 | 44CWI/56D1 | 73 | 5.1 | 8.0 | 80 | 0.3 | 80 |
| Example 8 | 58WEI/42D1 | 73 | 2.8 | 6.0 | 90 | 0.7 | 120 |
| Example 9 | 54BWIII/46D1 | 82 | 3.5 | 6.5 | 70 | 0.5 | 90 |
| Example 10 | 54BWIV/46D1 | 67 | 4.0 | 6.5 | 90 | 0.5 | 110 |
| Example 11 | 60BWI/40D1 | 73 | 3.8 | 6.5 | 60 | 0.4 | 80 |
| Example 12 | 48BWI/52D1 | 73 | 3.8 | 6.5 | 90 | 0.6 | 130 |
| Example 13 | 54FW/46D1 | 73 | 4.2 | 6.5 | 60 | 0.3 | 80 |
| Example 14 | 60GW/40D1 | 73 | 3.5 | 5.8 | 90 | 0.7 | 130 |
| Comparative Example 1 | 53A/47D2 | PP | — | — | 100 | Biaxial | 100 |
| Comparative Example 2 | 65AW/35D2 | 73 | 4.1 | 6.5 | 100 | Biaxial | 80 |
| Comparative Example 3 | 60AW/40D2 | 73 | 3.9 | 7.0 | 70 | Biaxial | 70 |
| Comparative Example 4 | 60AW/40D2 | 73 | 3.9 | 7.0 | 120 | Biaxial | 140 |
| Comparative Example 5 | 57.5A/42.5D2 | 73 | — | — | 70 | 1.0 | 105 |
| Comparative Example 6 | 80AW/20D2 | 73 | 3.9 | 7.0 | 150 | Biaxial | 140 |
| Comparative Example 7 | 57.5AW/42.5D2 | 73 | 3.9 | 7.0 | 70 | 2.4 | 105 |
| Comparative Example 8 | 57.5AW/42.5D2 | 73 | 3.9 | 7.0 | 70 | 0.2 | 120 |
| Comparative Example 9 | 57.5A/42.5D2 | 73 | — | — | 100 | Biaxial | 100 |

TABLE 4

| | Toner properties | | | | |
|---|---|---|---|---|---|
| | Z (Wax %) | Y (μm) (Particle Diameter) | X (Toner Tm) | XZ | XZ/Y |
| Example 1 | 3.5 | 8.5 | 129 | 452 | 53 |
| Example 2 | 3.5 | 9.0 | 128 | 448 | 50 |
| Example 3 | 3.5 | 9.0 | 128 | 448 | 50 |
| Example 4 | 3.5 | 9.0 | 130 | 455 | 51 |
| Example 5 | 3.5 | 9.0 | 130 | 455 | 51 |
| Example 6 | 3.5 | 9.0 | 130 | 455 | 51 |
| Example 7 | 3.5 | 9.0 | 127 | 445 | 49 |
| Example 8 | 3.5 | 9.0 | 129 | 452 | 50 |
| Example 9 | 3.5 | 9.0 | 130 | 455 | 51 |
| Example 10 | 3.5 | 9.0 | 128 | 448 | 50 |
| Example 11 | 3.9 | 9.5 | 128 | 500 | 53 |
| Example 12 | 3.1 | 8.0 | 128 | 397 | 50 |
| Example 13 | 3.5 | 9.0 | 124 | 434 | 48 |
| Example 14 | 3.5 | 9.0 | 135 | 473 | 53 |
| Comparative Example 1 | 3.5 | 7.0 | 127 | 445 | 64 |
| Comparative Example 2 | 4.2 | 8.5 | 133 | 559 | 66 |
| Comparative Example 3 | 4.2 | 8.0 | 125 | 525 | 66 |
| Comparative Example 4 | 4.2 | 8.0 | 124 | 521 | 65 |
| Comparative Example 5 | 4.0 | 8.0 | 125 | 500 | 63 |
| Comparative Example 6 | 5.6 | 10 | 132 | 739 | 74 |
| Comparative Example 7 | 4.0 | 7.5 | 124 | 496 | 66 |
| Comparative Example 8 | 4.0 | 7.5 | 124 | 496 | 66 |
| Comparative Example 9 | 4.0 | 7.5 | 124 | 496 | 66 |

The separativeness, thermostable storage stability, image glossiness, filming and adherence of the toner were evaluated.

<Separativeness>

The linear speed and temperature of the fixer of IPSiO CX2500 from Ricoh Company, Ltd. were modified to have 125 mm/sec and 140 to 190° C., respectively. A solid image developed with the toner of 1.1±0.1 mg/cm$^2$ having a 3 mm wide blank at the tip was fixed on a transfer paper TYPE 6200 Y from Ricoh Company, Ltd. The Separativeness was evaluated based on the following standard.

The fixer was modified to a soft roller formed of a fluorochemical surface material. Specifically, as shown in FIG. 2, the heat roller 21 includes an elastic layer 25 formed of a silicone rubber, having a thickness of 1.5 mm and a PFA surface layer 24 on an aluminum core metal 24 having an outer diameter of 40 mm and including a heater 27. The pressure roller 22 includes an elastic layer 29 formed of a silicone rubber, having a thickness of 3 mm and a PFA surface layer 30 on an aluminum core metal 28 having an outer diameter of 35 mm. A 7 mm wide nip is formed at a pressure-applied contact point between the heat roller 21 and the pressure roller 22. The fixer further includes a separation plate 23 separating a sheet a toner image is fixed on from the pressure roller 21. A fixing oil was not used.

○: Separable/non offset temperature not less than 50° C.

Δ: not less than 30° C. less than 50° C.

X: less than 30° C.

<Thermostable Storage Stability>

After the toner was stored at 50° C. for 8 hrs, the toner was sieved with a 42 mesh sieve for 2 min.

◎: The residual ratio less than 10%

○: not less than 10% less than 20%

Δ: not less than 20% less than 30%

X: not less than 30%

<Image Glossiness>

The linear speed and temperature of the fixer of IPSiO CX2500 from Ricoh Company, Ltd. were modified to have 125 mm/sec and 165° C., respectively. A solid image developed with the toner of 1.1±0.1 mg/cm$^2$ having a 3 mm wide blank at the tip was fixed on a transfer paper TYPE 6200 Y from Ricoh Company, Ltd. The image glossiness was measured with a gloss meter from Nippon Denshoku Industries Co., Ltd. at an incident angle of 60°.

○: not less than 5

Δ: not less than 3 less than 5 (practically usable)

X: less than 3 (practically unusable)

<Filming>

After 2,000 predetermined print pattern images having a printed ratio of 6% were continuously produced by IPSiO CX3000 from Ricoh Company, Ltd. at 23° C. and 45% RH, the photoreceptor and intermediate transfer belt were visually observed.

○: Neither filming nor black spot was observed

Δ: Filming or black spot was observed on the photoreceptor or intermediate transfer belt, but not on the images and practically usable X: Filming or black spot was observed on the photoreceptor or intermediate transfer belt, and on the images and practically unusable <Adherence>

After 2,000 predetermined print pattern images having a printed ratio of 6% were continuously produced by IPSiO CX3000 from Ricoh Company, Ltd. at 23° C. and 45% RH, the developing roller and images were visually observed.

○: Neither toner stripe nor stagnation was observed on the sleeve

Δ: Toner stripe or stagnation was slightly observed on the sleeve, but not on the images and practically usable X: Toner stripe or stagnation was widely observed on the sleeve, and practically unusable due to additional problems such as an abnormal noise.

The evaluation results are shown in Table 5.

TABLE 5

| | Evaluation | | | | |
|---|---|---|---|---|---|
| | Separativeness | Glossiness | Adherence | Filming | Thermostable storage stability |
| Example 1 | ○ | Δ | ○ | ○ | ○ |
| Example 2 | ○ | Δ | Δ | Δ | Δ |
| Example 3 | ○ | Δ | Δ | Δ | Δ |
| Example 4 | ○ | Δ | ○ | ○ | ○ |
| Example 5 | ○ | Δ | ○ | ○ | ○ |
| Example 6 | Δ | Δ | ○ | Δ | ○ |
| Example 7 | ○ | ○ | ○ | Δ | Δ |
| Example 8 | ○ | Δ | ○ | ○ | ○ |
| Example 9 | ○ | Δ | ○ | ○ | ○ |
| Example 10 | ○ | Δ | Δ | Δ | Δ |
| Example 11 | ○ | Δ | Δ | Δ | Δ |
| Example 12 | Δ | ○ | ○ | ○ | ○ |
| Example 13 | Δ | ○ | Δ | Δ | Δ |
| Example 14 | ○ | Δ | ○ | ○ | ○ |
| Comparative Example 1 | X | ○ | X | X | X |
| Comparative Example 2 | X | X | X | X | X |
| Comparative Example 3 | X | ○ | X | ○ | Δ |
| Comparative Example 4 | X | ○ | X | Δ | Δ |
| Comparative Example 5 | X | ○ | X | X | X |
| Comparative Example 6 | X | Δ | X | X | X |

TABLE 5-continued

| | Evaluation | | | | |
|---|---|---|---|---|---|
| | Separa-tiveness | Glossiness | Adherence | Filming | Thermostable storage stability |
| Comparative Example 7 | X | ○ | X | X | X |
| Comparative Example 8 | X | ○ | Δ | Δ | Δ |
| Comparative Example 9 | X | ○ | X | X | X |

As shown in Table 5, the toners of Examples 1 to 14 have better separativeness better than those of Comparative Examples 1 to 9, and less adhere to the developing blade than those thereof.

This application claims priority and contains subject matter related to Japanese Patent Application No. 2006-347262 filed on Dec. 25, 2006 the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner for a non-magnetic one-component developer, comprising:

a binder resin;

a wax present dispersing in the toner in the shape of a particle; and a colorant, wherein the wax having a particle diameter not less than 2.0 μm and less than 3.0 μm is not less than 20% and less than 40% by number based on total number thereof; the wax has a mode value not less than 1.5 μm and less than 2.0 μm in a frequency distribution of 0.1 μm width; and the following relationship is satisfied:

$$45<XZ/Y<62$$

wherein X represents a softening point (° C.) of the toner and is from 124° C. to 135° C.; Y represents a volume-average particle diameter (μm) of the toner and is from 6 μm to 10 μm; and Z represents a total parts by weight of the wax included in 100 parts by weight of the toner and is from 3.1 to 3.9.

2. The toner of claim 1, wherein the wax having a particle diameter not less than 2.5 μm is less than 20% by number.

3. The toner of claim 1, wherein the wax having a particle diameter not less than 1.5 μm and less than 2.0 μm is not less than 35% and less than 45% by number.

4. The toner of claim 1, wherein the following relationship is satisfied:

$$400<XZ<540.$$

5. The toner of claim 1, wherein the wax comprises a paraffin wax.

6. The toner of claim 1, wherein the binder resin is a hybrid resin synthesized under the presence of the wax, comprising a polycondensation polymeric skeleton and a vinyl polymeric skeleton.

7. The toner of claim 6, wherein the wax has an average dispersion diameter of from 3 to 5 μm in the hybrid resin.

8. The toner of claim 1, wherein the wax has a melting point of from 70 to 80° C.

9. The toner of claim 1, wherein the wax has a ratio of from 3.2 to 3.8% by weight based on total weight of the binder resin and the wax.

10. The toner of claim 1, wherein the toner has a softening point of from 124 to 134° C.

11. A method of preparing the toner according to claim 1, comprising:

melting and kneading a resin, the hybrid resin synthesized under the presence of the wax and a colorant with a grind kneader to prepare a kneaded mixture; and extruding the kneading mixture.

12. A developer comprising the toner according to claim 1.

13. The toner of claim 1, wherein the binder resin is a hybrid resin synthesized under the presence of the wax, comprising a polycondensation polymeric skeleton and a vinyl polymeric skeleton, wherein the wax having a particle diameter not less than 2.5 μm is less than 20% by number and has an average dispersion diameter of from 3 to 5 μm in the hybrid resin, and wherein the following relationship is satisfied:

$$400<XZ<540.$$

14. An image forming method, comprising:

developing an electrostatic latent image with a developer comprising a toner to form a toner image on a transfer sheet;

fixing a toner image on the transfer sheet upon application of heat, wherein the toner is the toner according to claim 1.

15. An image forming method, comprising:

developing an electrostatic latent image with a developer comprising a toner to form a toner image on a transfer sheet;

fixing a toner image on the transfer sheet upon application of heat, wherein the developer is the developer according to claim 12.

16. The image forming method of claim 14, wherein the toner image is fixed on the transfer sheet without an oil.

17. The image forming method of claim 15, wherein the toner image is fixed on the transfer sheet without an oil.

18. A process cartridge, comprising a photoreceptor and an image developer, and at least one of a charger and a cleaner, wherein the image developer comprises the toner according to claim 1.

* * * * *